United States Patent [19]

Woodall

[11] Patent Number: 4,936,799

[45] Date of Patent: Jun. 26, 1990

[54] AUTOMOBILE BATTERY ELECTRICAL CONNECTOR ASSEMBLY

[76] Inventor: Edward P. Woodall, General Delivery, Beeville, Tex. 78102

[21] Appl. No.: 466,074

[22] Filed: Jan. 16, 1990

[51] Int. Cl.[5] ..... H01R 4/30

[52] U.S. Cl. ..... 439/755; 439/754

[58] Field of Search ..... 439/754–758

[56] References Cited

U.S. PATENT DOCUMENTS

| | | | |
|---|---|---|---|
| 3,783,439 | 1/1974 | Valentino | 439/755 |
| 3,821,694 | 6/1974 | Gottlieb | 439/755 |
| 4,377,317 | 3/1983 | Shekel et al. | 439/755 |
| 4,560,229 | 12/1985 | Benton | 439/754 |
| 4,636,025 | 1/1987 | Norris | 439/755 |
| 4,673,240 | 6/1987 | Byfield, Jr. | 439/755 |
| 4,797,111 | 1/1989 | Ackman | 439/755 |

*Primary Examiner*—Paula A. Bradley

*Attorney, Agent, or Firm*—Michael I. Kroll

[57] ABSTRACT

A pair of electrical connector assemblies are provided for an automobile battery having side mounts. Each assembly includes a double threaded stud which is removably threaded into one side mount so that a connector lug and a battery cable terminal can be securely attached thereto. A booster cable clamp can grip the connector lug when the battery needs to be charged.

10 Claims, 2 Drawing Sheets

(STUD ASSEMBLY)

AUTOMOBILE BATTERY ELECTRICAL CONNECTOR ASSEMBLY

BACKGROUND OF THE INVENTION

1. Field of the Invention

The instant invention relates generally to automobile battery accessories and more specifically it relates to an automobile battery electrical connector assembly.

2. Description of the Prior Art

Numerous automobile battery accessories have been provided in prior art that are adapted to connect the positive and negative terminals of batteries to the electrical systems of automobiles and the like. While these units may be suitable for the particular purpose to which they address, they would not be as suitable for the purposes of the present invention as heretofore described.

SUMMARY OF THE INVENTION

A primary object of the present invention is to provide an automobile battery electrical connector assembly that will overcome the shortcomings of the prior art devices.

Another object is to provide an automobile battery electrical connector assembly for a six or twelve volt side mount battery that is used in an automobile and the like so that a booster cable clamp can be quickly attached to a connector lug.

An additional object is to provide an automobile battery electrical connector assembly in which a double threaded stud is utilized to replace the old style little cap screw.

A further object is to provide an automobile battery electrical connector assembly that is simple and easy to use.

A still further object is to provide an automobile battery electrical connector assembly that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
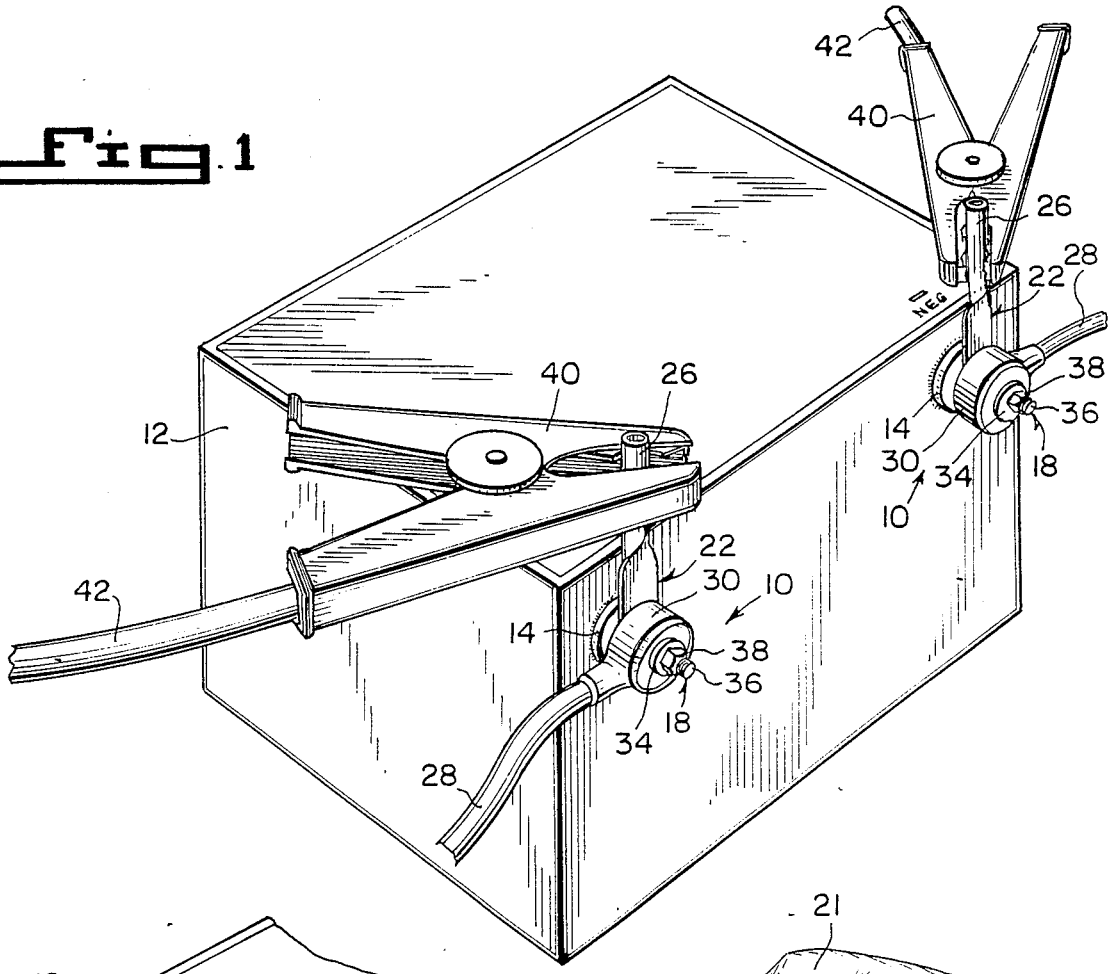
FIG. 1 is a perspective view of the invention installed on a side mount battery with booster cable clamps engaging with connector.

Turning now descriptively to the drawings, in which similar reference characters denote similar elements throughout the several views, the Figures illustrate a pair of electrical connector assemblies 10, for an automobile battery 12 having positive and negative side mounts 14 with threaded apertures 16. Each assembly

Figure 2:
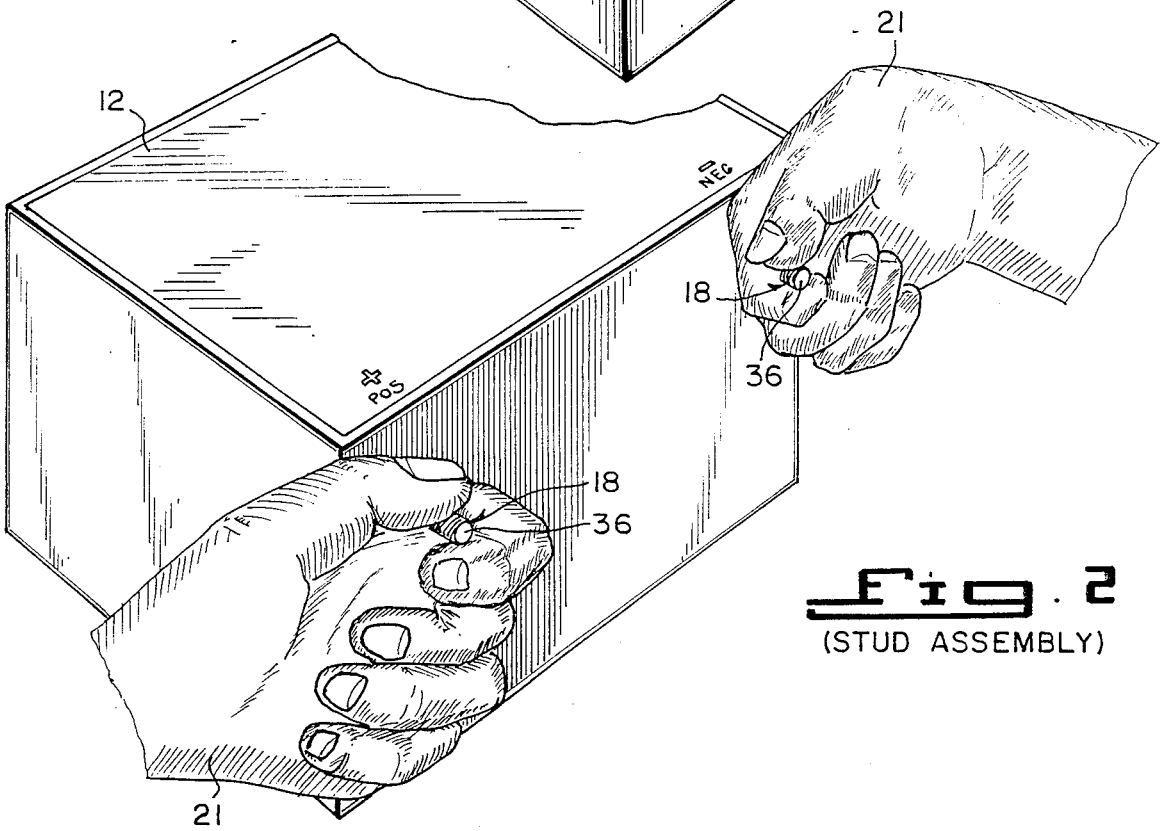
FIG. 2 is a perspective view of the side mount battery showing the studs being installed into the side mount threaded apertures.
Figure 3:
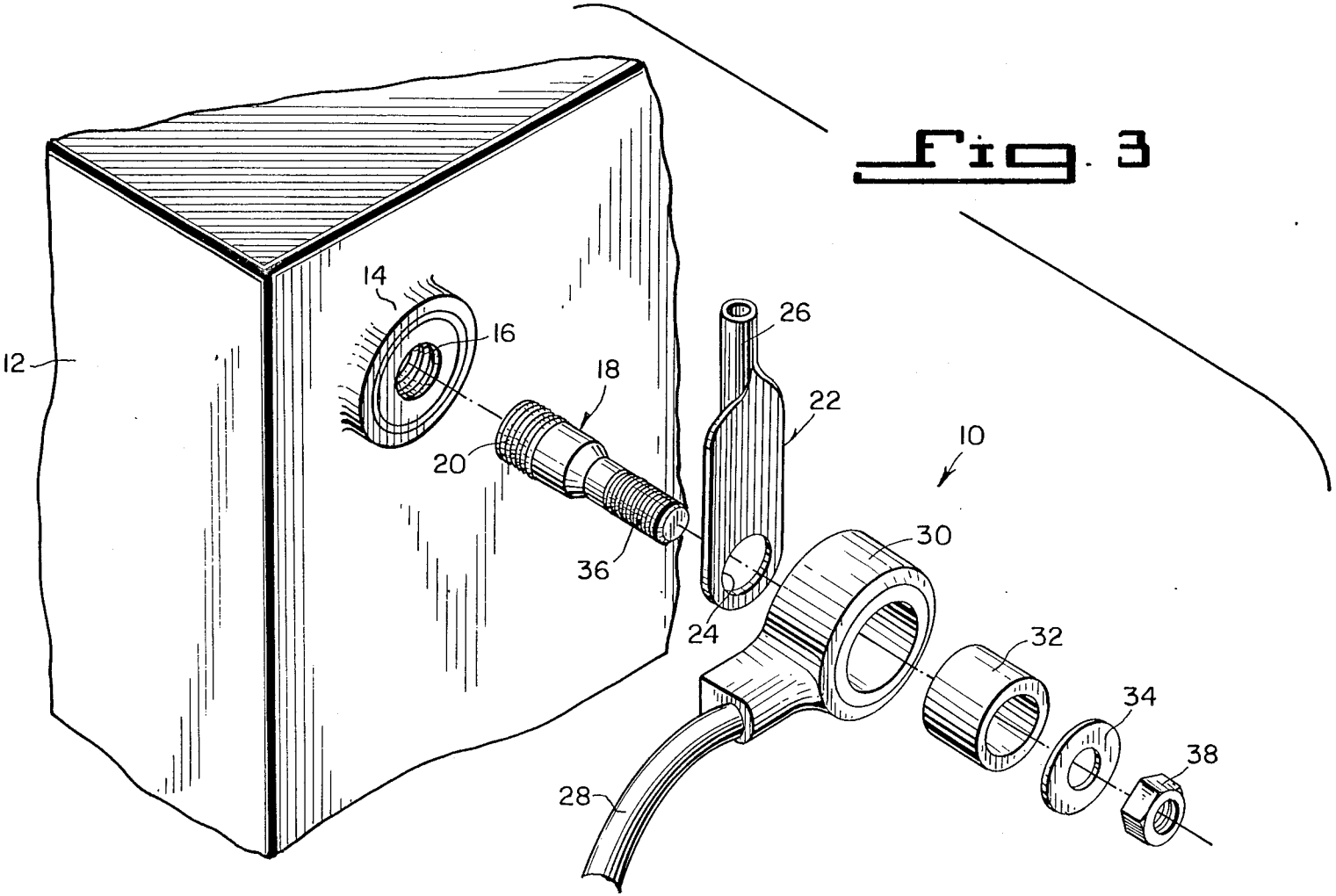
FIG. 3 is an exploded perspective view of the invention.

10 contains a stud 18 having threads at each end so that a first threaded end 20 can be removably threaded, horizontally, as shown in FIG. 2 by hands 21, into the threaded aperture 16 in the side mount 14 of the automobile battery 12. A connector lug 22 has a hole 24 at one end and an elongated tubular portion 26 at other end. The hole 24 in the connector lug 22 fits onto the stud 18 so that the elongated tubular portion 26 of the connector lug 22 is disposed in a vertical position with respect to the stud 18. A battery cable 28 is provided having a terminal 30 to fit onto the stud 18, while a sleeve 32 fits into the terminal 30 and onto the stud 18. A washer 34 fits onto a second threaded end 36 of the stud 18 and against the sleeve 32. A hex nut 38 threads onto the second threaded end 36 of the stud 18 so that when the hex nut 38 is tightened the assembly 10 will be secured to the side mount 14 of the automobile battery 12, thus allowing a booster cable clamp 40 on a booster cable 42 to grip the elongated tubular portion 26 of the connector lug 22, causing the automobile battery 12 to be charged when needed.

The first threaded end 20 of the stud 18 is larger in diameter than the second threaded end 36 of the stud 18 so as to properly fit into the threaded aperture 16 of the side mount 14 of the automobile battery 12 while allowing the hex nut 38 to properly fit onto the second threaded end 36 of the stud 18 and be tightened.

The stud 18, connector lug 22, terminal 30, sleeve 32, washer 34 and hex nut 38 are all fabricated out of highly electrical conductive material, such as brass or copper.

The electrical connector assemblies 10 will set the studs 18 up tight in the battery 12 which is important in carrying a heavy current or load, especially when starting in cold weather and with other heavy current drains. The studs 18 are easy to clean and remove from the battery 12. When the battery 12 needs to be taken out or put into the automobile, the studs 18 give a person a good hand hold to lift the battery 12 out or place it in. In case a person wants to change to another battery 12, the studs 18 can be removed from the old battery and screwed into the new one.

LIST OF REFERENCE NUMBERS

10 electrical connector assembly
12 automobile battery
14 side mount
16 threaded aperture
18 stud
20 first threaded end
21 hand
22 connector lug
24 hole
26 elongated tubular portion
28 battery cable
30 terminal
32 sleeve
34 washer
36 second threaded end
38 hex nut
40 booster cable clamp
42 booster cable It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An electrical connector assembly for an automobile battery having a side mount with a threaded aperture, said assembly comprising:

(a) a stud having threads at each end so that a first threaded end can be removably threaded horizontally into the threaded aperture in the side mount of the automobile battery;

(b) a connector lug having a hole at one end and an elongated tubular portion at other end, said hole in said connector lug fits onto said stud so that said elongated tubular portion of said connector lug is disposed in a vertical position with respect to said stud;

(c) a battery cable having a terminal to fit onto said stud;

(d) a sleeve to fit into said terminal and onto said stud;

(e) a washer to fit onto a second threaded end of said stud and against said sleeve; and (f) a hex nut to thread onto said second threaded end of said stud so that when said hex nut is tightened said assembly will be secured to the side mount of the automobile battery, thus allowing a booster cable clamp on a booster cable to grip said elongated tubular portion of said connector lug, causing the automobile battery to be charged when needed.

2. An electrical connector assembly as recited in claim 1, wherein said first threaded end of said stud is larger in diameter than said second threaded end of said stud so as to properly fit into the threaded aperture of the side mount of the automobile battery while allowing said hex nut to properly fit onto said second threaded end of said stud and be tightened.

3. An electrical connector assembly as recited in claim 2, wherein said stud is fabricated out of highly electrical conductive material.

4. An electrical connector assembly as recited in claim 3, wherein said connector lug is fabricated out of highly electrical conductive material.

5. An electrical connector assembly as recited in claim 4, wherein said terminal is fabricated out of highly electrical conductive material.

6. An electrical connector assembly as recited in claim 5, wherein said sleeve is fabricated out of highly electrical conductive material.

7. An electrical connector assembly as recited in claim 5, wherein said washer is fabricated out of highly electrical conductive material.

8. An electrical connector assembly as recited in claim 7, wherein said hex nut is fabricated out of highl electrical conductive material.

9. An electrical connector assembly as recited in claim 8, wherein said highly electrical conductive material is brass.

10. An electrical connector assembly as recited in claim 8, wherein said highly electrical conductive material is copper.

* * * * *